US005195195A

United States Patent [19]

Murray

[11] Patent Number: 5,195,195

[45] Date of Patent: Mar. 23, 1993

[54] HEADBOARD

[76] Inventor: James J. Murray, 282 Century Way, Manalapan, N.J. 07726

[21] Appl. No.: 956,390

[22] Filed: Oct. 5, 1992

[51] Int. Cl.[5] ..... A47C 31/00; A47C 21/00

[52] U.S. Cl. ..... 5/53.1; 5/406

[58] Field of Search ..... 5/53.1, 53.2, 53.3, 5/402, 403, 406, 407, 424, 282.1, 285

[56] References Cited

FOREIGN PATENT DOCUMENTS

| | | | |
|---|---|---|---|
| 2820005 | 4/1979 | Fed. Rep. of Germany | 5/406 |
| 1228074 | 8/1960 | France | 5/403 |
| 803611 | 10/1958 | United Kingdom | 5/53.1 |
| 828172 | 2/1960 | United Kingdom | 5/53.1 |
| 2107978 | 5/1983 | United Kingdom | 5/53.1 |

*Primary Examiner*—Alexander Grosz
*Attorney, Agent, or Firm*—Charles I. Brodsky

[57] ABSTRACT

The described invention allows a do-it-yourselfer to customize a headboard to coordinate with a purchased comforter simply, quickly and inexpensively. To accomplish this, a groove is provided along the back-side of the headboard, inwardly from its outer edge, and over which a matching fabric to the comforter is stretched taut; a flexible tubing is then fit over the fabric to snugly force it into the groove, where it is further held in place by a pair of added, overlapping legs which extend to secure the headboard to the bed frame. The fabric can be easily changed at a later date, merely by unscrewing the securing legs and pulling up on the tubing in freeing the fabric from the groove.

9 Claims, 2 Drawing Sheets

HEADBOARD

FIELD OF THE INVENTION

This invention relates to a headboard for a bed and, more particularly, to a headboard which is to be coordinated with a purchased comforter, simply, quickly and inexpensively.

BACKGROUND OF THE INVENTION

As is well known and understood, it is not unusual to spend anywhere from $250.00 to $800.00 to customize a headboard to match a desired comforter, depending upon the size of the headboard. As is similarly well known and appreciated, it typically takes anywhere from 3–6 weeks from the time such an order is placed, until it is completed. With this in mind, it is easy to appreciated one's reluctance to change comforter designs at a later date, because to do so, would entail these costs and delays all over again. And, similarly for such reason, it is not too difficult to understand why parents would go forward in customizing the headboards to the comforters in their own room—but not to do so in the rooms of their children, where the comforters and allied sheeting are typically changed as the child grows older—in proceeding from cartoon designs, for example, to pre-teen, and then to teenage preferences in bedding.

OBJECTS OF THE INVENTION

It is thus an object of the present invention to provide a headboard which allows a do-it-yourselfer to customize a headboard to coordinate with a purchased comforter simply, quickly and inexpensively.

It is another object of the invention to permit such customizing to be changed at a later date, just as simply, just as quickly, and just as inexpensively.

It is a further object of the invention to provide such a headboard which can be put together with a minimum of tools—and, preferably, with just a single screwdriver and scissors.

SUMMARY OF THE INVENTION

As will become clear hereinafter, the combination of the present invention allows all this to occur by incorporating a groove along the back-side of the headboard, inwardly from its outer edge, and over which a matching fabric to the comforter is stretched taut. A flexible tubing is then fit over the fabric to snugly force it into the groove, where it is further held in place by a pair of added, overlapping legs which extend to secure the headboard to the bed frame. In a preferred embodiment, to be described below, the groove extends along the back-side of the headboard approximately 1½ inches from its outer edge, and is cut substantially ⅜ inches deep and ¼ inches wide. The flexible tubing which holds the fabric snugly fit into the groove will be seen to be selected of a substantially ⅜ inch outer diameter and a ⅛ inch inner diameter. Where desired, a further matting can be adhesively secured to the front-side of the headboard, beneath the stretched fabric, to give the headboard a "puffier", more professional look, with the headboard then being secured to the opposing legs by means of a pair of countersunk screws. In this preferred embodiment of the invention, everything can be packaged together as a kit—except for the fabric—with the component parts immediately available for installation to the headboard and to the frame of the bed. Once so installed, the fabric can be easily changed at a later date—when the comforter is changed—merely by unscrewing the overlapping legs and pulling up on the flexible tubing to free the fabric from the described groove.

BRIEF DESCRIPTION OF THE DRAWINGS

These and other features of the invention will be more clearly understood from a consideration of the following description, taken in connection with the accompanying drawing in which FIGS. 1–4 several views of various parts of a construction according to a preferred embodiment of the invention, helpful in an understanding of its fabrication and operation.

DETAILED DESCRIPTION OF THE DRAWING

Figure 1:
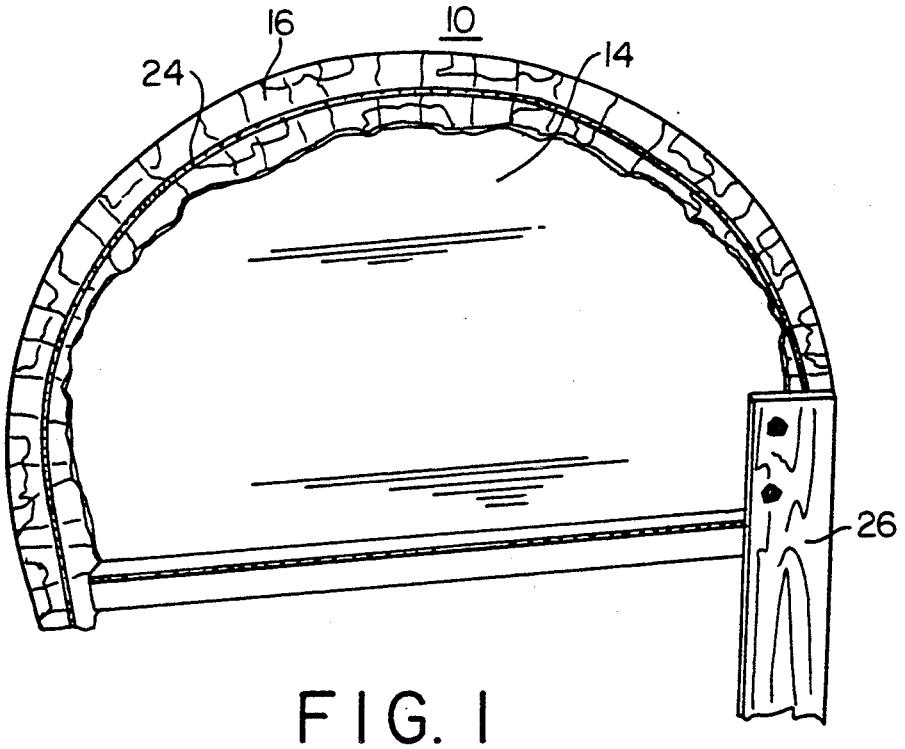
FIG. 1 shows a back view of the headboard.
Figure 2:
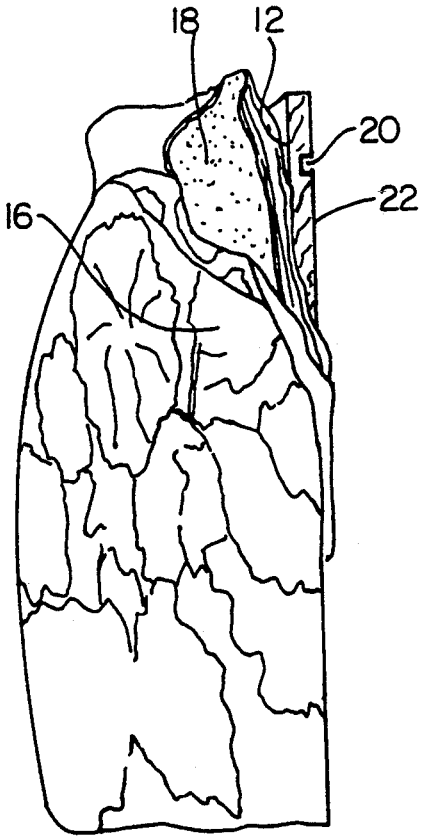
FIG. 2 shows a side view of the headboard.
Figure 3:
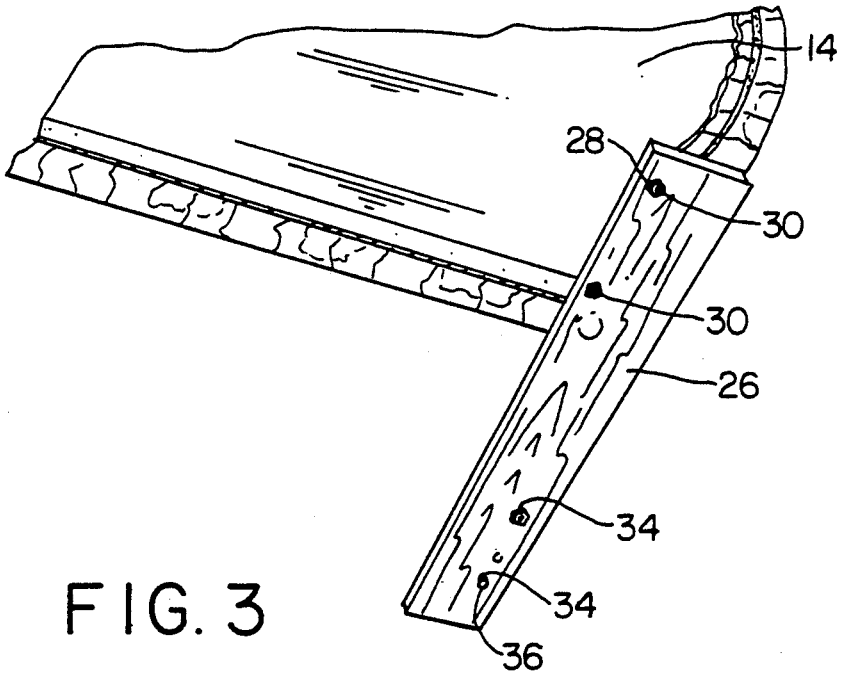
FIG. 3 shows another back view of the headboard.
Figure 4:
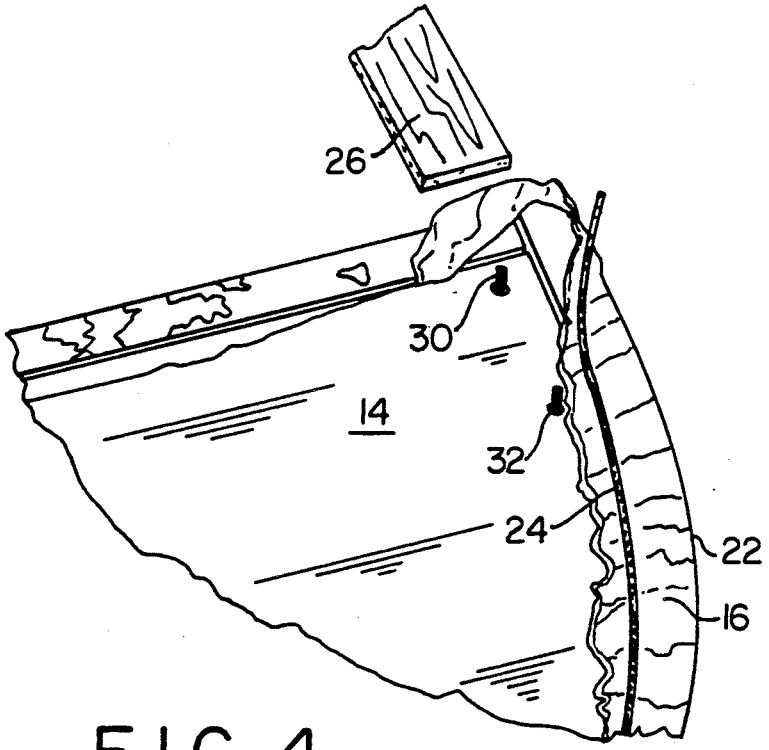
FIG. 4 shows yet another back view of the headboard.

In FIGS. 1–4, the headboard 10—whether king-size, queen-size, full-size, or twin-size—is illustrated as having a front-side 12 and a back-side 14. A fabric 16 selected to match a purchased comforter is illustrated, to be secured to the front-side 12 of the headboard, over an included matting of any appropriate type, and which is typically adhesively secured to the headboard 10 in standard fashion. As various sheets and pillow cases are normally purchased at the same time that a comforter is purchased, the teachings of the present invention envisions the further purchase of yet an additional sheet, which is to serve as the headboard covering according to the invention.

As further illustrated, a groove 20 is cut into the headboard 10 along its back-side 14, and extends along the back-side 14 inwardly from its outer edge 22. In a preferred embodiment, such groove 20 may be cut substantially ⅜ inches deep and ¼ inches wide to accept a flexible tubing 24 in a manner to be described. More specifically, the fabric 16 will be understood to be stretched taut in covering the front-side 12 of the headboard 10, to extend around the outer edge 22 and over the groove 20 to seat along the back-side 14 of the headboard 10, where it can eventually be cut with an ordinary pair of scissors. According to the invention, on the other hand, the tubing 24 will be appreciated to be selected sufficiently flexible and of comparable dimension to fit over the fabric 16, and to snugly force it into the groove 20, to there hold it in place. In accomplishing this, a plastic or rubber tubing of a substantially ⅜ inch outer diameter and ⅛ inch inner diameter has been found to provide the snug fit in holding the fabric fast in position.

As is also shown in FIGS. 1–4, a pair of legs 26 are further included, to overlap at least a portion of the tubing 24 and the fabric 16—both to assist in further holding the fabric and tubing in place, but also to secure the back-side of the headboard 10 to the frame of the bed (not shown). Thus, the legs 16 are shown as including 4 sets of holes—two of which are utilized in screwing the legs 26 to the headboard 10, and the others of which are used in screwing the legs 26 to the bed. As is more clearly shown, the first holes 28 are designed to accept a pair of screws 30, the heads of which will be understood to be countersunk into the front-side 12 of the headboard 10, beneath the matting 18, the shanks of which extend through the holes 28 so as to secure to the legs 26 by means of a pair of nuts, or similar such fasteners 32. As will be appreciated, these legs 26—once held in position by the screws 30—also serve to exert a pressure against the stretched fabric 16 and the flexible tubing 24, in a direction to further force the tubing 24 into the groove 20. On the other hand, the second set of holes 34 are provided to accept a second pair of screws 36, aligned in opposite orientation, extending through the legs 26, so as to join up and mate with the comparably aligned holes in the frame of the bed, where they are again secured, by another pair of nuts (not shown). As will be appreciated, such second pair of screws 36 are inserted into either the top two of the three holes 34, or into the bottom two holes, depending upon the height above the mattress selected for the headboard.

As will be appreciated, by stretching the fabric 16 taut, by employing a snugly fitting flexible tubing 24 to force the fabric 16 into the groove 20, and by supplementing the force applied with the legs 26, the end result is to hold the fabric in place, stretching across the front side 12 of the headboard 10. All that is needed to carry out the installation is a pair of scissors to cut the flexible tubing to the length desired—and, if also wanted, to shorten the length to which the fabric extends beyond the groove 20 on the back-side 14 of the headboard 10—and a single screwdriver to tighten the screws and nuts securing the legs 26 in place. As will also be seen, if it is desired to change the fabric covering at a later date, all that is necessary is to unscrew the legs 26, pull up on the flexible tubing 14, and remove the fabric 16 previously held within the then opened groove 20.

Testing has shown that this ability to give a "new look" to a headboard can be easily accomplished in no more than 30 minutes, requiring a minimum amount of skill. Further analysis has shown that when constructed as a kit, including all parts except for the fabric 16 (and, of course, except for the scissor and screwdriver), the total sales price has been projected to range from $45.00 to $60.00, depending upon the size of the headboard warranted by the bed construction. And, because of such reduced cost, and the low degree of skill required to complete an installation, the embodiment of the invention so described will be seen to be one which can easily adapt the changing preferences of a growing child in its desire for a comforter that reflects its changing tastes in growing from a toddler to a teenager, and which can be realized by the parent many times cheaper than a customized headboard otherwise might cost, and being able to be put together much faster and easier.

While there have been described what are considered to be preferred embodiments of the invention, it will be readily appreciated by those skilled in the art that modifications can be made without departing from the scope of the teachings herein. For at least such reason, therefore, resort should be had to the claims appended hereto for a true understanding of the invention.

I claim:

1. The combination for a bed comprising:

a headboard having front and back sides;

a groove provided along said back-side inwardly from its outer edge;

a fabric covering said front-side of said headboard and stretched taut around said outer edge and said groove to extend onto said back-side of said headboard;

a flexible tubing removably fit over said fabric and forcing said fabric into said groove;

and a pair of spaced apart legs removably secured to the back side of the headboard and overlapping at least a portion of said tubing, said legs having fastener means for removably securing the back-side of said headboard to the bed.

2. The combination of claim 1 wherein there is also included a matting secured to the front-side of said headboard, beneath said stretched fabric.

3. The combination of claim 2 wherein said matting is adhesively secured to said front-side of said headboard.

4. The combination of claim 2 wherein there is additionally included a pair of screws countersunk into the front-side of said headboard, beneath said matting, for securing said headboard to said pair of overlapping legs.

5. The combination of claim 4 wherein said groove extends along the back-side of the said headboard approximately 1½ inches inwardly from its outer edge.

6. The combination of claim 5 wherein said groove is cut substantially ⅜ inches deep and ¼ inches wide.

7. The combination of claim 6 wherein said flexible tubing is selected of a substantially ⅜ inch outer diameter and a ½ inch inner diameter.

8. The combination of claim 7 wherein there is further included two pairs of additional screws for securing said legs to the frame of the bed.

9. The combination of claim 8 wherein except for said fabric, said combination is packaged as a kit ready for installation to the frame of said bed.

* * * * *